US008312789B2

(12) United States Patent
Beck

(10) Patent No.: US 8,312,789 B2
(45) Date of Patent: Nov. 20, 2012

(54) FOOT PEDAL MODULE

(75) Inventor: Werner Beck, Amberg (DE)

(73) Assignee: ZF Friedrichshafen AG, Friedrichshafen (DE)

( * ) Notice: Subject to any disclaimer, the term of this patent is extended or adjusted under 35 U.S.C. 154(b) by 173 days.

(21) Appl. No.: 12/512,193

(22) Filed: Jul. 30, 2009

(65) Prior Publication Data

US 2010/0037726 A1 Feb. 18, 2010

(30) Foreign Application Priority Data

Aug. 13, 2008 (DE) ..... 10 2008 038 808

(51) Int. Cl.
*G05G 1/30* (2008.04)

(52) U.S. Cl. ..... 74/513; 74/560

(58) Field of Classification Search ..... 74/512, 74/513, 514, 560
See application file for complete search history.

(56) References Cited

U.S. PATENT DOCUMENTS

| | | | | |
|---|---|---|---|---|
| 1,939,221 | A * | 12/1933 | Nelson | 74/512 |
| 5,295,409 | A * | 3/1994 | Byram et al. | 74/514 |
| 6,330,838 | B1 * | 12/2001 | Kalsi | 74/514 |
| 6,408,712 | B1 * | 6/2002 | Bolisetty et al. | 74/514 |
| 6,591,712 | B2 * | 7/2003 | Goto et al. | 74/514 |
| 6,622,589 | B1 * | 9/2003 | Pino et al. | 74/513 |
| 6,718,845 | B2 * | 4/2004 | Menzies | 74/512 |
| 6,916,074 | B2 * | 7/2005 | Jung et al. | 303/3 |
| 7,044,019 | B2 * | 5/2006 | Hauschopp et al. | 74/512 |
| 7,319,319 | B2 | 1/2008 | Jones et al. | |
| 7,631,574 | B2 * | 12/2009 | Leone | 74/513 |
| 2003/0188600 | A1 * | 10/2003 | Slanec | 74/514 |
| 2004/0259687 | A1 * | 12/2004 | Ritter et al. | 477/187 |
| 2006/0053957 | A1 * | 3/2006 | Ewel et al. | 74/560 |
| 2007/0000345 | A1 * | 1/2007 | Leone | 74/513 |
| 2007/0193401 | A1 * | 8/2007 | Campbell | 74/560 |

FOREIGN PATENT DOCUMENTS

| | | | |
|---|---|---|---|
| DE | 44 07 005 | C1 | 3/1995 |
| DE | 201 20 658 | U1 | 6/2002 |
| DE | 101 33 194 | A1 | 1/2003 |
| DE | 102 55 712 | A1 | 6/2004 |
| DE | 20 2004 004 457 | U1 | 7/2005 |
| DE | 20 2004 004 454 | U1 | 8/2005 |
| DE | 10 2005 061 277 | A1 | 4/2007 |
| DE | 10 2006 057 311 | A1 | 5/2008 |
| WO | 03/038379 | A1 | 5/2003 |

* cited by examiner

*Primary Examiner* — Troy Chambers
*Assistant Examiner* — Gregory Prather
(74) *Attorney, Agent, or Firm* — Davis & Bujold PLLC

(57) ABSTRACT

A foot pedal module (1) including an enclosure (3), a rotor (11), a foot pedal (15), two springs (17, 19) and a circuit board (33). The enclosure (3) has a trunnion (5), an outer ring (29) and a cover (39) for accommodating and protecting the rotor (11). The rotor (11) is linked with a bushing (7), a tappet, a lever (13), two haptic springs (17, 19), two damping elements (21, 23) and a driving element (27). The circuit board (33) carries an inductor array (25) which are designed as flat coils and located opposite the damping elements (21, 23). The foot pedal (15) is linked to the lever (13) and bushing (7) by a ball joint (35) and a socket (27).

18 Claims, 5 Drawing Sheets

FOOT PEDAL MODULE

This application claims priority from German patent application serial no. 10 2008 038 808.4 filed Aug. 13, 2008.

FIELD OF THE INVENTION

The invention refers to a foot pedal module.

BACKGROUND OF THE INVENTION

Known as state of the art is, for instance, a configuration as described in DE 10 2005 061 277 A1, which is the basis of this invention. It describes a vehicle's accelerator pedal, comprising the following components:

- a basis part for a permanent installation in a vehicle,
- a pedal part, which can, with respect to the basis part, be pivoted around a pivot axle,
- an inductive sensor determining the pedal part's position, comprising an inductor configuration circuit mounted at the basis part, at least one sensor coil and at least one receiver coil, and a coupling part which moves in front of the coil configuration circuit upon the pedal part's movement,
- a lever part, which is positioned at the basis part's axle part, pivotable around a lever's pivot axle, and being coupled in a way with the pedal part, so that the lever part pivots in relationship to the basis part upon activation of the pedal part,
- whereby the pedal pivot axle is positioned distant and in parallel to the lever pivot axle, and the coupling part is attached to the lever part.

In addition, an accelerator pedal configuration for vehicles is known through DE 20 2004 004 454 U1. It is particularly designated for passenger automobiles and comprises:

- an accelerator pedal module, in which an accelerator pedal and a base plate which are movable relative to each other in at least one pivot point,
- a linear encoding unit, in which two segments are moved relative to each other,
- the one segment is mounted at the accelerator pedal, and the other segment being mounted at the base plate, and being designed in the shape of a partial circle,
- in the one segment, being a moving part, a torque motor sliding part is positioned, having arranged several, consecutive and one after the other permanent magnets, and in the other segment, being a stationary part, a torque motor stator part, having arranged several, consecutive and one after the other, field windings,
- and in one segment, in addition to the permanent magnets, a resonant circuit with at least one capacitor and one inductor are provided, and in the other segment, in addition to the field coils, at least three coils of the sensor's inductor circuit is provided.

Also, known through DE 20 2004 004 457 U1 is an additional accelerator pedal configuration for vehicles. The configuration comprises at least one sensor and one accelerator module, which is incorporates at least one accelerator pedal. By means of the accelerator pedal, a resonant circuit is altered between an actuation position and a non-actuation position in a way so that a corresponding signal is generated. The resonant circuit comprises at least one capacitor and at least one inductor which are shifted by means of the sensor's coil circuitry, comprising at least three coils.

Known from DE 102 55 712 A1 is an additional accelerator pedal construction for a vehicle. It comprises a contactless linear sensor, which incorporates a cursor part and a stator part. The linear sensor is being linked in a way to an accelerator pedal lever, so that the cursor part is coupled, free of play, to the accelerator pedal lever by means of a tappet.

At last, as described in DE 101 33 194 A1, an accelerator pedal construction to adjust the vehicle's driving speed is known, comprising

- an accelerator pedal plate
- at least one spring, which generates a reset force at the accelerator pedal plate
- a linking part which transfers the accelerator pedal plate's movement to the spring,
- at least one sensor, which generates a signal, depending on the accelerator pedal plate's activation, and which is a linear distance sensor,
- a friction part to generate a force hysteresis at the activation of the acceleration pedal plate, whereby the link is being guided by an (preferably rectangular) angled cast form at an enclosure and re-directing the movement of the accelerator pedal plate.

SUMMARY OF THE INVENTION

The purpose of this invention is the development of a foot pedal module, which is also based on inductive sensor technique and which, under simple manufacturing conditions, can transfer precisely the foot pedal's angular position.

Different from the state of the art, the perimeter area of the lever part or the rotor is not being used, but instead the rotor's front face, to attach the coupling part or the activator part. Thus, the geometric form of the activator parts, also avoiding a delicate dependence on distance issues, are much more easily matched to the shape of the inductor arrays. The category defining state of the art in DE 10 2005 061 277 A1 describes the difficulties as follows: "The coil circuitry, in accordance with the coupling part's described arch-shaped path, can exhibit a warping. Preferred, however, is a straight level coil circuitry, for instance, like a conventional circuit board. In this case, the manufacturing is more cost effective. Fact is that there exists a variable distance of the coupling part above the coil circuitry, due to the arch-shaped path. Any arising measuring errors, however, can be avoided by using in this case a heavy-duty, inductive sensor, as, for instance, described in WO-A-03/038379. Also, potential measuring error can be avoided through appropriate calibration."

The invention does not use any of these three options (arch-shaped inductor sensor, robust flat sensor, calibrated flat sensor), but a flat activator part, opposite to a flat circuit board, as an inductor carrier. Hereby, the difficulties of manufacturing the arch-shapes as well as the measuring errors can be avoided.

BRIEF DESCRIPTION OF THE DRAWINGS

The invention is described based on FIG. 1 to FIG. 4. Shown in here are.

DETAILED DESCRIPTION OF THE PREFERRED EMBODIMENTS

Figure 1:
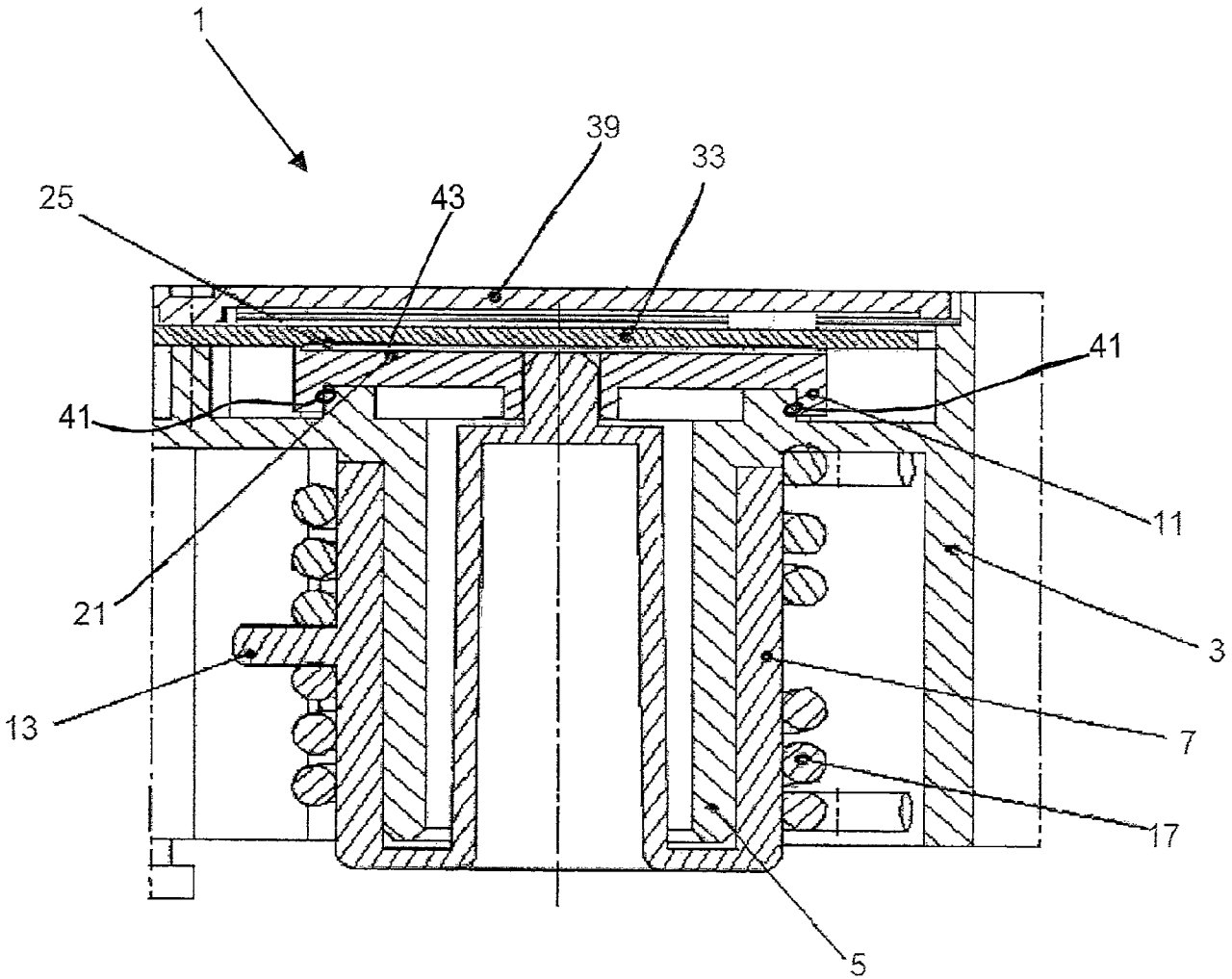
FIG. 1 a sectional view through an embodiment of a foot pedal module according to the invention.
Figure 1A:
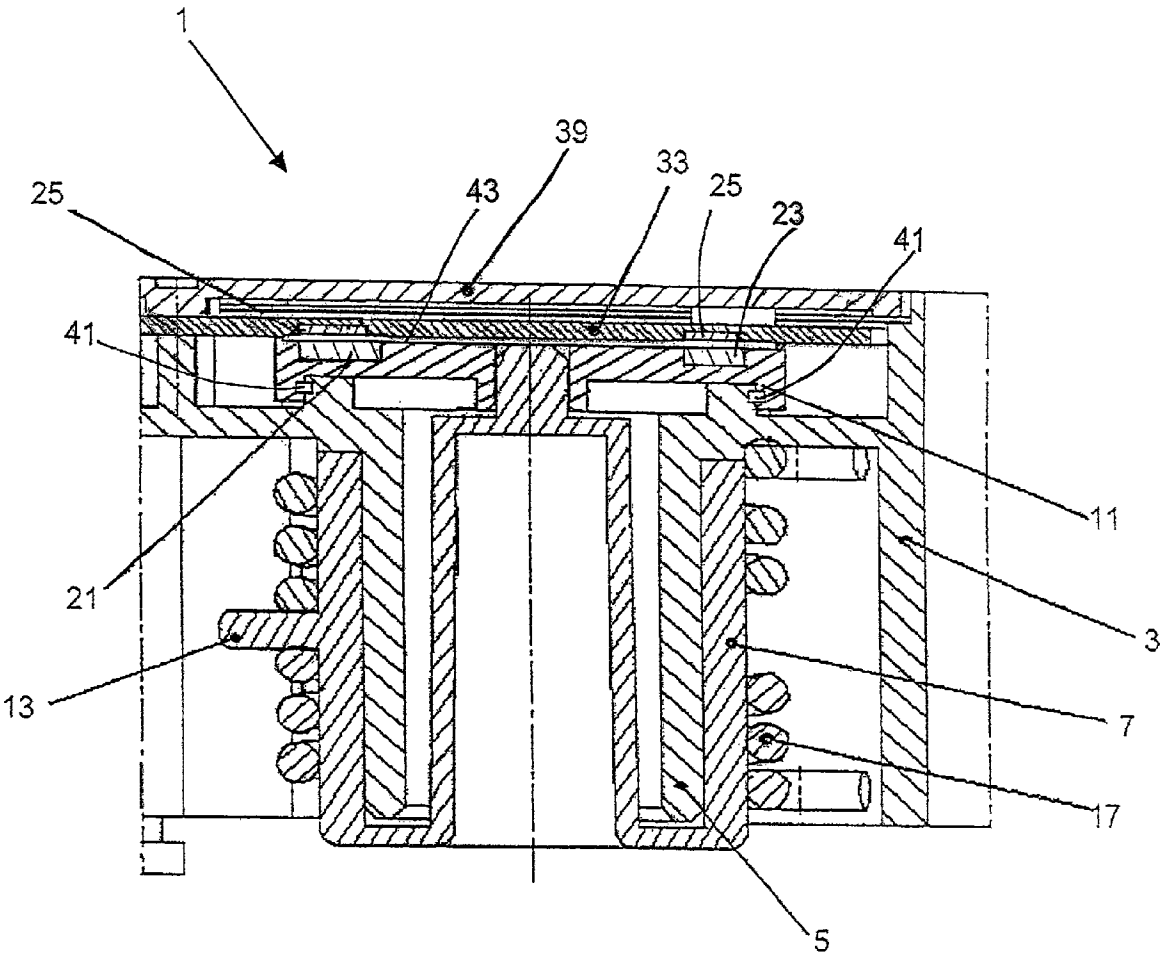

The foot pedal module 1 is protected by the enclosure 3, having an inserted or integrated trunnion 5. On this trunnion, which is firmly connected to the enclosure, a bushing 7 is positioned, which is slipped over the trunnion 5 during the assembly. The bushing 7 comprises (i) a tappet, designed as a driving element 27, for directing the rotor 11, also (ii) a lever 13, through which the distance to be measured, is being precisely transferred from a foot pedal 15 to the rotor 11.

Hence, the bushing 7 is driven by the foot pedal 15. The driver generates during the acceleration a certain compressive force on the foot pedal 15. This force will be passed on through a ball joint 35 (details in FIG. 4) and a socket 37 to the lever 13 and the bushing 7. Through pre-stressed springs 17 and 19, a driver experiences the usual resistance when putting pressure on the foot pedal 15. The mentioned driving element 27 (see FIG. 2 and 4) then actuates the rotor 11, which rotates on the enclosure's 3 outer ring 29 (see FIG. 4), in fact rotating exactly in accordance with the deflection of the foot pedal 15. By means of an inductor array 25, an electric signal is ultimately generated by the deflection.

Figure 2:
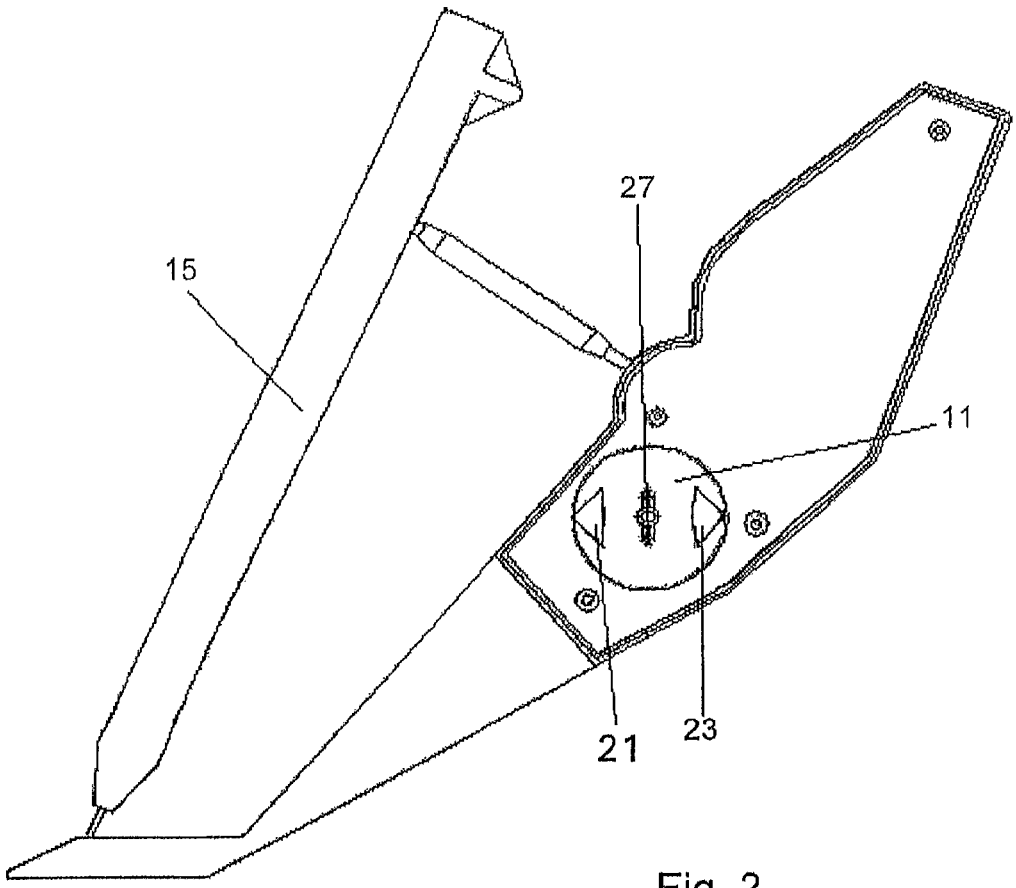
FIG. 2 a left side view of the foot pedal module according to FIG. 1.
Figure 3:
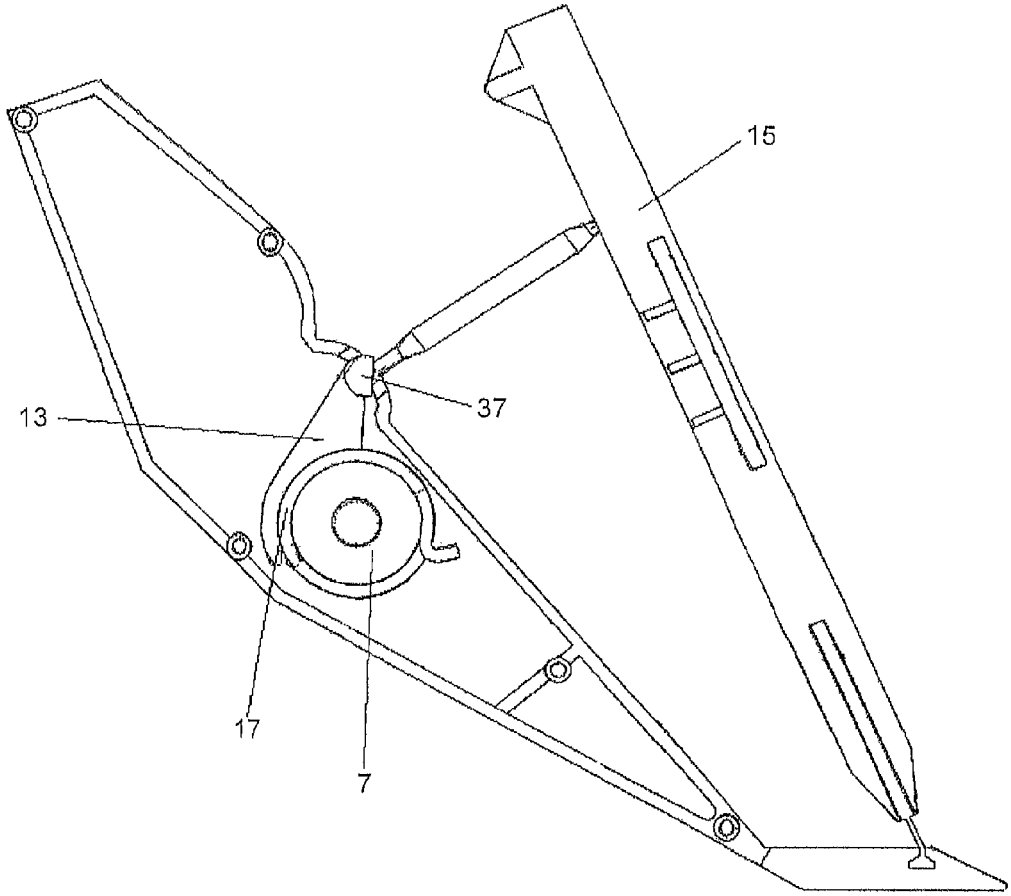
FIG. 3 a right side view of the foot pedal module according to FIG. 1.
Figure 4:
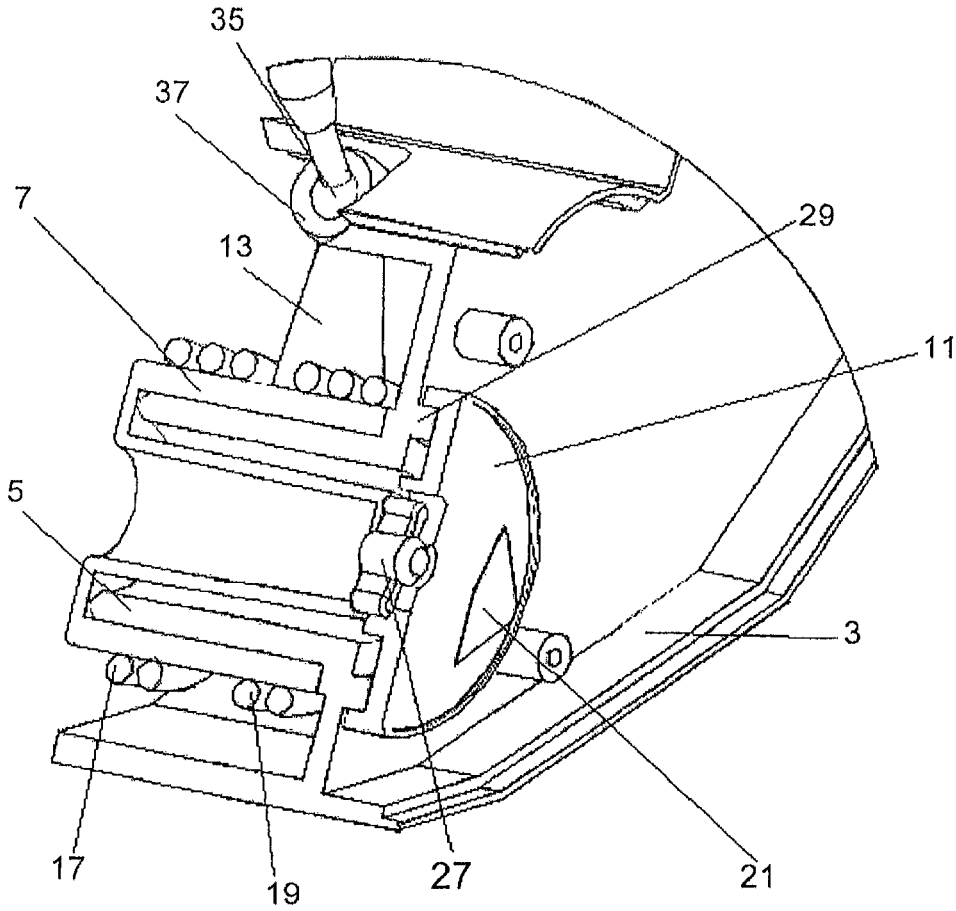
FIG. 4 a perspective view, partially sectioned, of the foot pedal module according to FIG. 1 to 3.

As shown in FIGS. 1, 2, and 4, the rotor 11 is positioned on the enclosure 3, interlocked and driven by the driving element 27. To guarantee a relatively free from play attachment of the rotor 11, the outer ring 29 is molded to the enclosure 3. In addition, a return spring (not shown here) can be positioned between the enclosure's 3 outer ring 29 and the rotor 11, which, in case of a failure of the driving element 27 or failure of any other section of the power train, instantly contributes to having the rotor 11 falling into a position which can be assigned through the coil detection as a definite failure.

The named haptic springs 17, 19 are doubled, for reasons of a reliable redundancy. They define the mechanical resistance which is experienced by the driver when operating the foot pedal 15, meaning that they provide haptic feedback.

The construction of the springs 17, 19 is designed for an equal distribution of the force, approx. 50:50. In case one spring 17, 19 should break, the driver will recognize a loss of force, signaling to the driver that one spring 17, 19 does not function anymore, but the system itself is still working properly.

In case of a deviation from the force's ratio of 50:50, for example at an assumed ratio of 20:80, the driver will most likely notice a force reduction in case the stronger spring would fail, but an non-experienced driver or student driver would not notice a failure of the weaker spring, because the reduction of the force is as little as 20%. For that reason, the force ratio of 50:50 is selected for the two springs 17, 19.

The electric signal conversion takes place based on inductive mode, through the movement of two damping elements 21, 23 (see FIGS. 2 and 4.). The two damping elements 21, 23 are, in relationship to the driving element 27, positioned at the front side of the rotor 11, opposite the corresponding inductor array 25 (see FIG. 2). For this purpose, the damping elements 21, 23 are positioned at the front, opposite of a circuit board 33, containing the related coil array 25. The coil array 25 is designed for the different precision requirements, as well as the planar shape of the related damping elements 21, 23. The second damping element 23 and an opposing coil array 25 are again provided to obtain a dependable redundancy.

Reference Character Listing:

1 Foot Pedal Module
3 Enclosure
5 Trunnion
7 Bushing
11 Rotor
13 Lever
15 Foot Pedal
17 First Haptic Spring
19 Second Haptic Spring
21 First Damping Element
23 Second Damping Element
25 Inductor Array
27 Driving Element
29 Outer Ring of Enclosure 3
33 Circuit Board
35 Ball Joint
37 Socket
39 Cover of Enclosure 3

The invention claimed is:

1. A foot pedal module (1) comprising:
an enclosure (3),
a rotor (11),
a foot pedal (15),
two haptic springs (17,19), and
a circuit board (33),
the enclosure (3) comprising a cylindrical trunnion (5), an outer ring (29), and a cover (39) for positioning and protecting the rotor (11), the two haptic springs (17, 19) and the circuit board (33), and the rotor (11) being linked to a bushing (7), a lever (13), the two haptic springs (17, 19), two damping elements (21, 23) and a driving element (27), the bushing being rotationally supported by an exterior of the trunnion and having an inner extension that axially extends through an interior of the trunnion, the rotor being drivingly coupled to the inner extension of the bushing,
the damping elements (21, 23) being carried on a front face of the rotor (11);
the circuit board (33) carrying an inductor array (25) in a shape and form of flat spiral coils;
the inductor array (25) being positioned opposite the damping elements (21, 23), and between the circuit board and the front face of the rotor (11), a foot pedal angular position signal is generated by the inductor array (25) and is based on movement of the damping elements (21, 23) with respect to the inductor array (25); and
the foot pedal (15) being linked with the lever (13) and the bushing (7) via a ball joint (35) and a socket (37).

2. The foot pedal module (1) according to claim 1, wherein a return spring (41) is directly linked to and between the bushing (7) and the rotor (11), the return spring (41) biases the rotor (11) into an error position when an interruption of a link (35, 37) between the foot pedal (15) and the lever (13) occurs.

3. A foot pedal module (1) being mechanically connected with a foot pedal (15) through a link (35, 37), the foot pedal module comprising:
an enclosure (3) having an axially extending cylindrical trunnion,
a rotor (11),
a bushing being rotationally supported by an exterior of the trunnion and axially extending through an interior of the trunnion, the bushing being drivingly connected to the rotor such that the bushing and the rotor rotate in unison,
first springs (17, 19), and
a circuit board (33),
a front face of the rotor (11), which is activated via the bushing by the foot pedal (15), carrying at least one activating element (21, 23),
the circuit board (33) having coil arrays, designed as one of flat coils (25) and hall sensors, being positioned opposite to the activating element (21, 23), a foot pedal angular position signal is generated by the coil arrays and is based on movement of the activating elements (21, 23) with respect to the coil arrays, and
a constant gap being located between the circuit board (33) and the activating element (21, 23); and the coil arrays being positioned between the circuit board and the front face of the rotor (11).

4. The foot pedal module (1) according to claim 3, wherein the least one activating element is an eddy current damping element (21, 23), movement of the eddy current damping element in relation to the flat coils alters at least one of an inductance of the flat coils (25) and a resonant frequency on the circuit board (33).

5. The foot pedal module (1) according to claim 3, wherein at least one of the activating elements is an eddy current damping element (21, 23) movement of the eddy current damping element in relation to the flat coils alters a magnetic coupling excitation of at least one of the flat coils with the flat sensor inductor (25).

6. The foot pedal module (1) according to claim 3, wherein the coil arrays are hall sensors and the at least one activating element is a permanent magnet, a signal is generated by the hall sensor, the signal indicates an angular position of the foot pedal which is based on movement and overlap of the permanent magnet with respect to the hall sensor.

7. The foot pedal module (1) according to claim 1, wherein at least one of the two haptic springs (17, 19), the two damping elements (21, 23), or the inductor array (25), is designed to be redundant.

8. The foot pedal module (1) according to claim 3, wherein the enclosure (3) includes the trunnion (5), an outer ring (29) and a cover (39) for accommodating and protecting the rotor (11), the first springs (17, 19) and the circuit board (33).

9. The foot pedal module (1) according to claim 3, wherein two activating elements (21, 23) are provided and the two activating elements (21, 23) are each damping elements (21, 23); and the rotor (11) is linked with the bushing (7), a driving element (27), and the first springs (17, 19), and also comprises a lever (13) and the two damping elements (21, 23), the first springs are two haptic springs (17, 19).

10. The foot pedal module (1) according to claim 3, wherein the foot pedal (15) is flexibly linked, via a ball joint (35) and a socket (37), with a lever (13) of the bushing (7).

11. The foot pedal module (1) according to claim 3, wherein a second spring directly engages with only the enclosure (3) and the rotor (11) and, upon an interrupt of the link (35, 37) between the foot pedal (15) and a lever (13), the second spring, which is a return spring, biases the rotor (11) into a desired position.

12. The foot pedal module (1) according to claim 1, wherein the trunnion (5), the bushing (7), the two haptic springs (17, 19), the outer ring (29) and the rotor (11) are all arranged concentrically with respect to one another.

13. The foot pedal module (1) according to claim 3, wherein the trunnion (5), defines a rotational axis, and the enclosure (3) comprises an outer ring (29) which is coaxial with the trunnion (5) and axially extends opposite from the trunnion (5);

the rotor (11) is coaxially aligned with the trunnion (5) on the bushing (7) which coaxially extends through a radial interior and on a radial exterior of the trunnion such that the bushing radially encloses the trunnion (5), the bushing (7) comprises a driving element (27) which engages and rotatably drives the rotor (11) as the bushing (7) rotates, the rotor (11) is supported by the outer ring (29), and the bushing (7), the driving element (27) and the rotor (11) are rotatable with respect to the trunnion (5) and the circuit board (33)

a lever (13) is integrally coupled to the bushing (7), and the link (35, 37) couples the foot pedal (15) to the lever (13) such that the bushing (7) rotates when the foot pedal (15) is actuated;

the first springs (17, 19) surround the bushing (7) and apply a resistant force on the bushing (7) that is opposite to a direction of rotation when the bushing (7) is driven by the foot pedal (15), the first springs (17, 19) each applies a substantially equal amount of the resistant force on the bushing (7); and the trunnion (5), the bushing (7), the first springs (17, 19), the outer ring (29) and the rotor (11) are all arranged concentrically with respect to one another.

14. The foot pedal module according to claim 13, wherein the trunnion comprises an axially extending outer face and the bushing is cylindrical and comprises an outer surface which axially extends in a first direction away from the rotor, the outer surface of the bushing slidably mates with and overlays the outer face of the trunnion such that the bushing rotates about the rotational axis in relation to the trunnion.

15. The foot pedal module according to claim 14, wherein the lever is integral with the outer surface of the bushing and extends radially therefrom, and the first springs encircle the outer surface of the bushing.

16. The foot pedal module according to claim 14, wherein the bushing comprises an end surface, which extends radially, inwardly from the outer surface of the bushing, and an inner projection that axially extends in a second direction toward the rotor, remote ends respectively of the inner projection and the outer surface are integrally continuously coupled to each other by the end surface, the outer face of the trunnion axially extends radially between the outer surface and the inner projection of the bushing.

17. The foot pedal module according to claim 16, wherein the driving element is integral with the inner projection of the bearing such that the driving element rotatably drives the rotor about the rotational axis as the bushing rotates about the rotational axis.

18. The foot pedal module according to claim 13, wherein the rotor comprises an axially extending flange and the outer ring of the enclosure comprises an axially extending outer surface, the flange of the rotor slidably mates with the outer surface of the outer ring of the enclosure such that the rotor is rotatably supported by the outer ring of the enclosure.

* * * * *